United States Patent [19]

Nagase

[11] 4,087,950

[45] May 9, 1978

[54] TRANSOM OR LIKE FIXED SASH WINDOW WITH IMPROVED MOUNTING MEANS

[75] Inventor: Mitsuo Nagase, Kurobe, Japan

[73] Assignee: Yoshida Kogyo K.K., Tokyo, Japan

[21] Appl. No.: 760,096

[22] Filed: Jan. 17, 1977

[30] Foreign Application Priority Data

Jan. 21, 1976 Japan ..... 51-6097

[51] Int. Cl.[2] ..... E04B 1/62

[52] U.S. Cl. ..... 52/397; 52/402; 52/475

[58] Field of Search ..... 52/397, 400, 402, 475, 52/476, 498

[56] References Cited

U.S. PATENT DOCUMENTS

| | | | |
|---|---|---|---|
| 3,040,847 | 6/1962 | Webster | 52/400 |
| 3,071,215 | 1/1963 | Gall | 52/475 X |
| 3,774,360 | 11/1973 | Hubbard et al. | 52/397 X |

*Primary Examiner*—Ernest R. Purser

*Assistant Examiner*—Carl D. Friedman

*Attorney, Agent, or Firm*—Hill, Gross, Simpson, Van Santen, Steadman, Chiara & Simpson

[57] ABSTRACT

A fixed sash window comprises an outer frame within which there is fixedly mounted a sash including an inner frame embracing the periphery of a panel of glass or like material. The outer frame has formed therein inwardly opening grooves for receiving respective tongues projecting outwardly from the inner frame. The inwardly opening groove in either the sill or header or the outer frame is defined in part by a snap-on batten occupying part of a recess formed longitudinally in the sill or header along one of its inside edges. The inner frame is made smaller in size than the outer frame, to such a degree that gaps are formed therebetween to accommodate sealing strips of rubber or the like which are dually effective for weathertightly sealing the gaps and making the inner frame immovable with respect to the outer frame.

5 Claims, 2 Drawing Figures

TRANSOM OR LIKE FIXED SASH WINDOW WITH IMPROVED MOUNTING MEANS

BACKGROUND OF THE INVENTION

1. Field of the Invention

This invention relates to windows in general and, in particular, to a transom or like fixed sash window. Even more particularly, the invention deals with such a fixed sash window having improved means for mounting a sash within an outer frame.

2. Description of the Prior Art

In transoms and other fixed sash windows heretofore proposed and used, the installation of a sash within an outer frame has in some instances been a highly troublesome and time-consuming job. Some prior art fixed sash windows also have difficulties in securely holding the sash in position within the outer frame and in weathertightly sealing the windows.

SUMMARY OF THE INVENTION

It is an object of this invention to provide a transom or other fixed sash window so made that a sash can be easily and speedily mounted within an outer frame.

Another object of the invention is to provide a transom or other fixed sash window in which the sash, once mounted within the outer frame, can be securely held in position therein and which at the same time is sealed effectively.

In accordance with this invention, briefly stated, there is provided a fixed sash window comprising a generally rectangular outer frame having inwardly opening grooves formed therein. One these grooves, formed in either the header or sill of the outer frame, is defined in part by a batten fixedly mounted in and extending along a recess formed along one of the longitudinal inside edges of the header or sill. Mounted within the outer frame, a sash includes an inner frame embracing the periphery of a glass or other panel and having outwardly projecting tongues which are received in the respective grooves of the outer frame. The inner frame is smaller than the space bounded by the outer frame, so that gaps are formed therebetween to accommodate sealing means which serves the dual purposes of sealing the window and making the inner frame immovable with respect to the outer frame.

In a preferred embodiment of this invention, the batten is adapted to snap into position on the recessed header or sill. Thus, for mounting the sash within the outer frame, the tongues of the inner frame may first be manipulated into the respective grooves of the outer frame, the snap-on batten having been removed from the recessed header or sill. The batten is then snapped into position on the header or sill, and the sealing means such as strips of rubber or like elastic material are then forced into the gaps between the outer and inner frames. The manipulation of the tongues into the grooves is extremely easy since one side of the groove in the header or sill is rendered open by the removal of the snap-on batten.

Many other advantages and features of the present invention will become manifest to those versed in the art upon making reference to the detailed description and the accompanying sheets of drawings in which a preferred structural embodiment incorporating the principles of the present invention is shown by way of example.

DESCRIPTION OF THE PREFERRED EMBODIMENT

Figure 1:
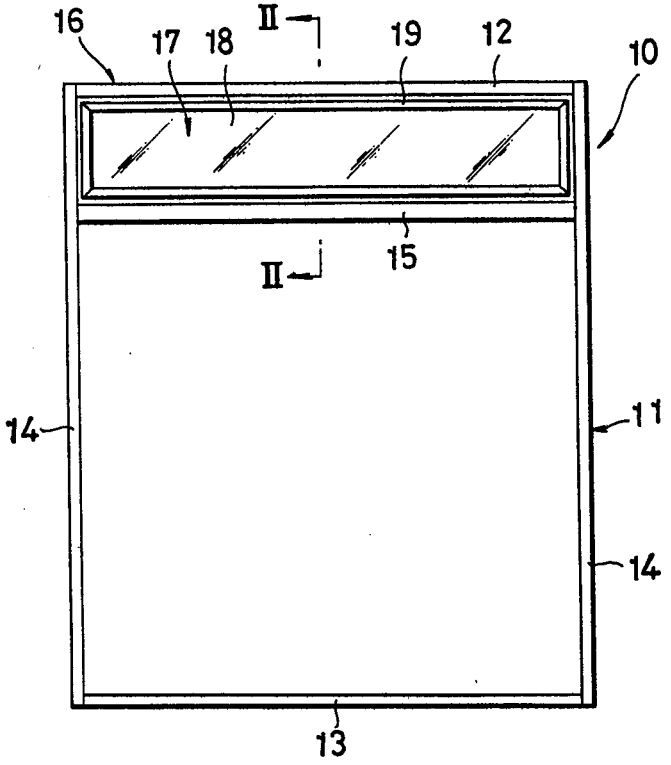
FIG. 1 is an elevational view of a transom provided above a conventional window, with the transom being constructed in accordance with the novel concepts of this invention.

In the accompanying drawings this invention is shown adapted for a transom, generally designated 10, that is located above a conventional window of, for example, the sliding or rolling sash type. With reference first to FIG. 1, an outer frame 11 of the conventional window is adapted to be fixed in the usual rough opening in an enclosing wall. The outer frame 11 comprises a header 12, a sill 13, and a pair of side jambs 14 secured at their ends in any convenient manner to the header and sill. Additionally, a crossbeam 15 extends horizontally between, and is conveniently secured at its ends to, the pair of side jambs 14 some distance under the header 12.

A rectangular outer frame 16 for the transom 10 is formed by the header 12, the crossbeam or sill 15 doubling as the header of the outer frame 11 of the conventional window, and those portions of the side jambs 14 which extend above the sill 15. Fixedly mounted within this outer frame 16, in the manner hereinafter set forth, is a sash or panel assembly 17 comprising a panel or pane 18 of glass or other suitable material and an inner frame 19 extending around and embracing the periphery of the panel.

Figure 2:
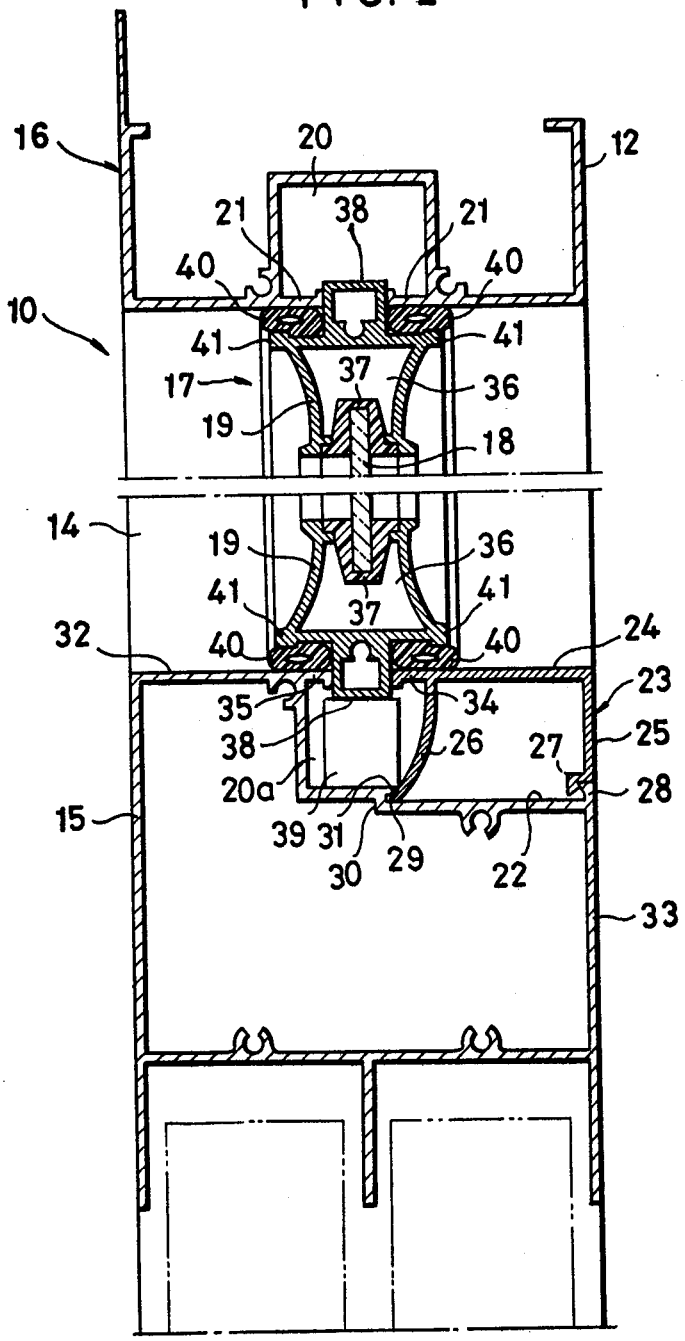
FIG. 2 is an enlarged vertical cross-sectional view, partly broken away, of the transom taken along the line II—II of FIG. 1.

As illustrated in a vertical section and on a greatly enlarged scale in FIG. 2, inwardly opening grooves 20 are formed in the respective constituent members 12, 14 and 15 of the outer frame 16 of the transom 10 so as to be all disposed in the median plane of the transom. Of these inwardly opening grooves 20, the one formed in the sill 15 is of somewhat different character from the other grooves and is therefore designated **20*a***, as is later explained in detail.

Each of the inwardly opening grooves 20 in the header 12 and the side jambs 14 of the outer frame 16 has a pair of flanges 21 projecting toward each other in coplanar relationship from the opposed longitudinal edges at the open end of the groove.

The confronting edges of each pair of flanges 21, disposed parallel to each other with a spacing therebetween, are crimped outwardly, that is, toward the inside of the respective groove 20, for purposes hereinafter made apparent.

The sill 15 of the outer frame 16 has a recess 22 extending longitudinally along one of its inside edges. Mounted in this recess 22 and extending therealong is a snap-on batten, generally designated 23, that coacts with the recessed sill 15 to define the aforesaid inwardly opening groove **20*a*. The batten 23 is shown to be of substantially inverted-U-shaped cross section, comprising a web 24 and first and second side walls 25 and 26 formed along and angled downwardly from the opposite longitudinal edges of the web. The following means are employed to permit the batten 23 to snap into position on the recessed sill 15 following the installation of the sash 17 within the outer frame 16**.

Disposed at a right angle with the web 24, the first side wall 25 of the batten 23 terminates in an L-shaped flange 27 formed to make interlocking engagement with a rim 28 formed along the longitudinal edge of the bottom of the recess 22. The second side wall 26, which is shown to be curved away from the first side wall 25 as it extends downwardly, may have its lower edge 29 slightly bent as shown. For engaging this bent edge 29 of the second side wall 26, the bottom of the recess 22 is stepped at 30 and is further provided with an overhanging flange 31 of comparatively short extent.

Thus, for mounting the snap-on batten 23 on the recessed sill 15, the bent edge 29 of its second side wall 26 may first be placed under the overhanging flange 31 so that it will make abutting contact with the step 30. The web 24 of the batten 23 may then be manually depressed to force the L-shaped flange 27 of its first side wall 25 into interlocking engagement with the rim 28.

Preferably, a suitably angled or rounded guide surface or surfaces should be formed on either or both of the L-shaped flange 27 and the rim 28 in order to permit smooth movement of the former into interlocking engagement with the latter. Furthermore, in spite of the showing of FIG. 2, the second side wall 26 of the batten 23 may also be formed in right-angular relationship to its web 24, in which case the edge 29 of the second side wall may be bent right-angularly away from the first side wall 25. If desired, the bent edge 29 of the second side wall 26 and the flanged step 30 of the recessed sill 15 may also be so shaped and sized relative to each other that the former may snap into interlocking engagement with the latter.

With the batten 23 snapped into position on the recessed sill 15 in the above described manner, its web 24 is disposed in coplanar relationship to the inside surface 32 of the sill, whereas the first side wall 25 of the batten is disposed flush with the lateral surface 33 of the sill. The snap-on batten 23 may therefore be considered substantially an integral part of the sill 15 in the completed transom 10.

The aforementioned inwardly opening groove **20*a* is defined in part by the second side wall 26 of the batten 23**.

The batten 23 is further provided with a flange 34 projecting from its web 24 beyond the second side wall 26. Another flange 35 projects from the inside surface 32 of the sill 15 toward the flange 34 in coplanar relationship thereto. As in the case of the pairs of flanges 21 at the open ends of the other inwardly opening grooves 20, the confronting edges of the flanges 34 and 35 are disposed in spaced parallelism and are crimped outwardly or toward the inside of the groove **20*a***.

Within the outer frame 16 of the foregoing construction there is mounted the sash or panel assembly 17 including the inner frame 19 which, as will be seen by referring back to FIG. 1, comprises top and bottom horizontal members and a pair of side vertical members combined rectangularly in any convenient manner. These constituent members of the inner frame 19 are so shaped as to form a continuous, inwardly opening peripheral gap 36 to receive the peripheral portion of the panel 18 which is shown to be conventionally provided with a continuous sealing strip 37 wrapped over the edge of the panel.

The inner frame 19 is made smaller in size than the space bounded by the inside surfaces of the outer frame 16, for purposes later described. The inner frame 19 has tongues 38 projecting outwardly therefrom, with all these tongues being disposed in the median plane of the transom 10 and extending longitudinally of the respective constituent members of the inner frame. The tongues 38 are received in the respective inwardly opening grooves 20 and **20*a* of the outer frame 16**.

The tongues 38 have a thickness considerably less than the width of the inwardly opening grooves 20 and **20*a*. However, since the tongues 38 are caught securely between the pairs of crimped flanges 21 at the open ends of the grooves 20 and by the pair of crimped flanges 34 and 35 at the open end of the groove 20*a*, the sash 17 is restrained from any lateral displacement relative to the outer frame 16**.

The width of the tongues 38 is uniform and is also considerably less than the depth of the inwardly opening grooves 20 and **20*a*. Preferably, a suitable support such as that shown at 39 should be provided on the bottom of the inwardly opening groove 20*a* to allow the sash 17 to rest thereon at the time of its installation in the outer frame 16. Since the inner frame 19 of the sash 17 is smaller than the space bounded by the outer frame 16, gaps will be created all around the inner frame as one of its tongues 38 is placed upon the support 39** at the time of installation.

These gaps between the outer and inner frames 16 and 19 receive sealing strips 40 of rubber or like elastic material which serve the triple purposes of weather-tightly sealing the gaps, centering the inner frame and making the inner frame immovable with respect to the outer frame. Preferably, suitable rims or ridges should be formed on either or both of the outer and inner frames 16 and 19, as shown for example at 41, for retaining the sealing strips 40. While in the illustrated embodiment the sealing strips 40 are shown to be provided on both sides of the tongues 38, it is possible to provide such sealing means only on one side of the tongues.

For mounting the sash 17 within the outer frame 16, the side tongues 38 and then the top tongue 38 of the inner frame 19 may first be manipulated into the respective inwardly opening grooves 20 of the outer frame by suitably moving the entire sash relative to the outer frame, and the bottom tongue 38 of the inner frame may be placed upon the support 39, the snap-on batten 23 having been removed from the recessed sill 15 of the outer frame. The batten 23 is then snapped into position on the recessed sill 15 in the above described manner, thereby completing the inwardly opening groove **20*a* in which is received the bottom tongue 38 of the inner frame 19 resting on the support 39. Subsequently, the sealing strips 40 are forced into the gaps between the outer and inner frames 16 and 19 from the opposite sides of the transom 10**.

Although the present invention has been shown and described as adapted specifically for a transom, it will be apparent that the invention is adaptable for any fixed sash window regardless of its place of installation. Further, while the snap-on batten is shown attached to the sill of the outer transom frame in the illustrated embodiment, it is possible to attach such a batten to the header by forming a longitudinal recess therein instead of in the sill. This and other modifications or changes may be resorted to by one skilled in the art without departing from the scope of the invention as defined by the following claims.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A fixed sash window comprising, in combination:

(a) a generally rectangular outer frame of metal having inwardly opening grooves formed therein, said outer frame including a header, a sill and two jambs one of which has a recess extending longitudinally along one of the inside edges thereof;

(b) a batten fixedly mounted in and extending along said recess whereby the adjacent inwardly opening groove is defined in part by said batten;

(c) a sash including a panel peripherally surrounded by a continuous sealing strip carried in a rigid inner frame of metal extending along and embracing the periphery of said sealing strip, said inner frame corresponding in shape to, but being smaller than, the space bounded by said outer frame and disposed therein, whereby gaps are created therebetween, said inner frame having tongues of metal projecting outwardly therefrom across said gaps and received in said inwardly opening grooves, respectively, of said metal outer frame in metal-to-metal engagement; and (d) sealing means disposed in said gaps between said outer frame and said inner frame at at least one side of said tongues for weather-tightly sealing the window and for making said inner frame immovable with respect to said outer frame.

2. A fixed sash window according to claim 1, said tongues of said inner frame having a thickness considerably less than the width of said inwardly opening grooves of said outer frame, and said outer frame having a pair of metal flanges projecting toward each other from the opposed longitudinal edges at the open end of each of said inwardly opening grooves, each of said tongues being held between the respective pair of flanges whereby said sash is restrained from lateral displacement with respect to said outer frame.

3. A fixed sash window according to claim 1, said tongues of said inner frame having a width considerably less than the depth of said inwardly opening grooves of said outer frame, and support means on the bottom of said inwardly opening groove of said sill of said outer frame for supporting said metal inner frame thereon in a predetermined position with respect to said outer frame.

4. A fixed sash window according to claim 1, including rims on said inner frame projecting into at least one of said gaps for retaining said sealing means within said gaps.

5. A fixed sash window according to claim 1, said sealing means being disposed on both sides of said tongues and encircling said inner frame.

* * * * *